United States Patent [19]

Cleary et al.

[11] 4,248,027

[45] Feb. 3, 1981

[54] APPARATUS FOR FILLING CONTAINERS

[75] Inventors: William Cleary; Ivan J. Farrow, both of King's Lynn, England

[73] Assignee: Cleary & Co. Ltd., King's Lynn, England

[21] Appl. No.: 962,879

[22] Filed: Nov. 22, 1978

[30] Foreign Application Priority Data

Dec. 8, 1977 [GB] United Kingdom ..... 51054/77

[51] Int. Cl.[3] ..... B65B 5/10; B65B 1/06; B65B 1/08

[52] U.S. Cl. ..... 53/244; 53/251

[58] Field of Search ..... 53/473, 475, 251, 281, 53/244, 503, 237, 266 R; 198/418; 141/180, 102, 100, 9; 222/185, 559, 196, 197, 227

[56] References Cited

U.S. PATENT DOCUMENTS

| | | | |
|---|---|---|---|
| 2,509,069 | 5/1950 | Mrachek | 53/244 |
| 2,590,823 | 3/1952 | Rhodes | 53/244 X |
| 2,846,830 | 8/1958 | Bossi | 53/473 |
| 3,512,336 | 5/1970 | Rosecrans | 53/244 X |
| 3,920,134 | 11/1975 | Scarpa et al. | 53/251 X |
| 4,094,129 | 6/1978 | List | 198/418 X |

*Primary Examiner*—Horace M. Culver
*Attorney, Agent, or Firm*—Darbo & Vandenburgh

[57] ABSTRACT

Apparatus for filling containers with articles.

A feed conveyor of slats having article receiving apertures is supplied with articles from a chute or a vibratory hopper. A tray below the slats prevents articles falling through until a discharge point is reached where the tray terminates, allowing articles to fall into a transverse line of hoppers below the conveyor.

A gate prevents the articles from leaving the hoppers until a line of empty cans on a second transverse conveyor are in position therebelow.

A stop across the end of the hopper prevents excess articles entering the feed conveyor.

A rotary brush or roller clears any surplus articles from the feed conveyor.

4 Claims, 6 Drawing Figures

APPARATUS FOR FILLING CONTAINERS

FIELD OF INVENTION

This invention relates to apparatus for introducing articles into containers and a method of operating same whereby the containers are stationary while they are being filled with the articles.

THE INVENTION

As a result of the method of operation, apparatus embodying the invention can operate at high speed and can typically handle 120 containers per minute.

According to the present invention apparatus for introducing articles into containers comprises a feed conveyor which is adapted to convey and retain articles thereon up to a discharge point at which the articles leave the conveyor and enter a plurality of hoppers which extend transversely relative to the feed conveyor, a second conveyor for feeding containers beneath the hoppers, stop means for retaining a batch of containers below the hoppers and gate means operable when an empty batch of containers is located beneath the hoppers to open and release the content of the hoppers into the containers until the latter are full whereupon the said gate means is closed, the stop means are removed and the batch of filled containers are conveyed away and replaced by another batch of empty containers ready to be filled.

Preferably means is provided for ensuring that none of the articles are left on the feed conveyor beyond the discharge point. Depending on the nature of the articles the means may comprise a roller or brush or the like.

Preferably means is provided for feeding articles onto the feed conveyor, at a point remote from the discharge point and at a sufficient distance therefrom to ensure that the articles are uniformly distributed over the conveyor before reaching the discharge point.

Preferably the feed conveyor is formed from transverse slats each having apertures therein through which the articles can fall and a tray is located below the conveyor between the point at which the articles are supplied to the conveyor and the discharge point so that the apertures in the slats cooperate with the tray to form pockets in which the articles collect. In this way it is easy to see if there is a non-uniform distribution since this will show up in the event that two articles attempt to rest in a single pocket or one of the pockets remains empty. To this end an operator may be positioned adjacent the feed conveyor with access to a reserve supply of articles which he can use to fill up any empty pockets and to allow excess articles to be removed.

Alternatively automatic means may be provided for sensing an empty pocket and conveying an article thereto or for sensing when an article has failed to be located on the tray at the bottom of a pocket and to remove the article by sweeping or sucking or blowing.

In accordance with a preferred method of operation, the speed of operation of the feed conveyor, and the synchronous operation of the gating means are such that 50% of the articles to be deposited in the empty containers are collected in the hoppers while the gate means is shut and the batch of filled containers is removed and replaced by a batch of empty containers and the remaining 50% of the articles to be deposited in the containers drop from the feed conveyor as the latter passes over the hoppers while the gate means remains open. At the end of the cycle the gate means is shut once again, the batch of filled containers is removed and while the batch of empty containers is located beneath the hoppers, 50% of the next quantity of articles is being collected by the hoppers from the feed conveyor.

According to a preferred feature of the present invention apparatus for introducing articles into containers of the type described hereinafter referred to as "the said apparatus", further comprises a vibratory hopper for receiving incoming articles, a pluraity of parallel spaced apart guides defining lanes having inputs which are supplied with articles from the hopper and outputs for supplying articles collated into a corresponding number of parallel lines of articles to the feed conveyor of said apparatus, and in which the feed conveyor includes apertures into which the articles individually fit and the apparatus further comprises a plurality of rotatable fingers at least one for each of the said lanes, and means for driving same in synchronism with the speed of the feed conveyor so that each of the apertures in the latter is passed over by a rotating finger moving in a rearward direction as the aperture passes below the line of rotatable fingers, to cause articles which have not become lodged in one of the apertures to be swept back towards the hopper for recycling into an aperture in the feed converyor.

Preferably the fingers comprise flaps which extend radially from a common shaft which is adapted to be driven.

Preferably the fingers or flaps are formed at least in part from a resilient member which is adapted to deform or permit the finger to be deformed to accommodate any over-sized articles or any articles which might otherwise become jammed.

Preferably the drive for the fingers is obtained from the same drive as is provided for moving the feed conveyor to facilitate synchronising the two drives.

Preferably means is provided for adjusting the phase of the movement of the fingers relative to the arrival therebetween of apertures in the feed conveyor.

Preferably a series of fingers are situated at each of the locations above the said lanes supplying the feed conveyor, each said series being arranged circularly around a central axle which serves to rotate the said fingers.

The invention will now be described by way of example with reference to the accompanying drawings.

DETAILED DESCRIPTION OF THE FIGURES

Figure 2:
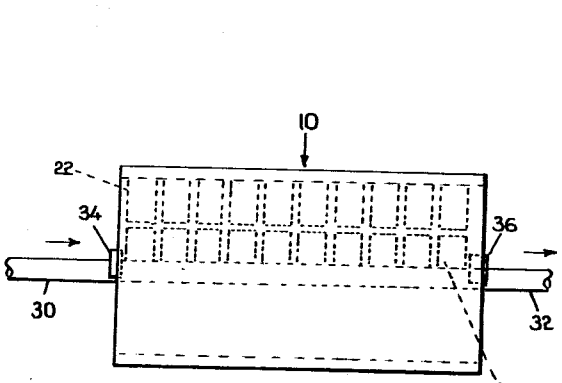
FIG. 2 is a front elevation of the apparatus shown in FIG. 1 looking in the direction of the arrow X.

The apparatus shown in the drawings is specifically designed for collating meat balls and delivering these to a batch of empty cans for filling the cans with an appropriate number of meat balls. The number which will be delivered to each can is determined by the speed of operation of the feed conveyor and the synchronous operation of the gate or flap (to be described).

Although not shown, an operator or automatic means is provided for ensuring that the feed conveyor is completely filled with the meat balls between the delivery point at which the meat balls are deposited on the feed conveyor and the discharge point at which the meat balls leave the conveyor for the hoppers.

Figure 1:
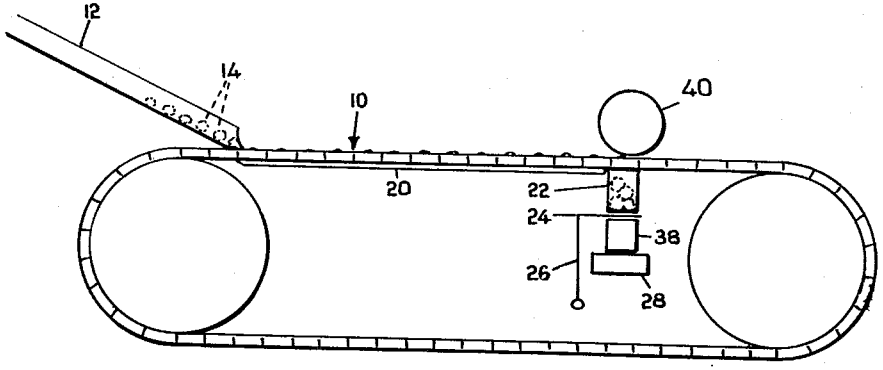
FIG. 1 is a side elevation of an apparatus embodying the invention for feeding meat balls into stationary cans.

Referring specifically to FIGS. 1 and 2, meat balls are delivered to a feed conveyor generally designated 10 by means of a feed hopper 12. The meat balls are designated by the reference numeral 14.

Figure 3:
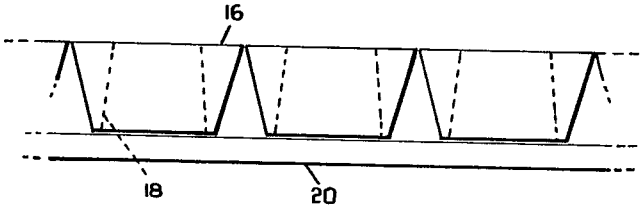
FIG. 3 is a side view of the feed conveyor drawn to an enlarged scale.
Figure 5:
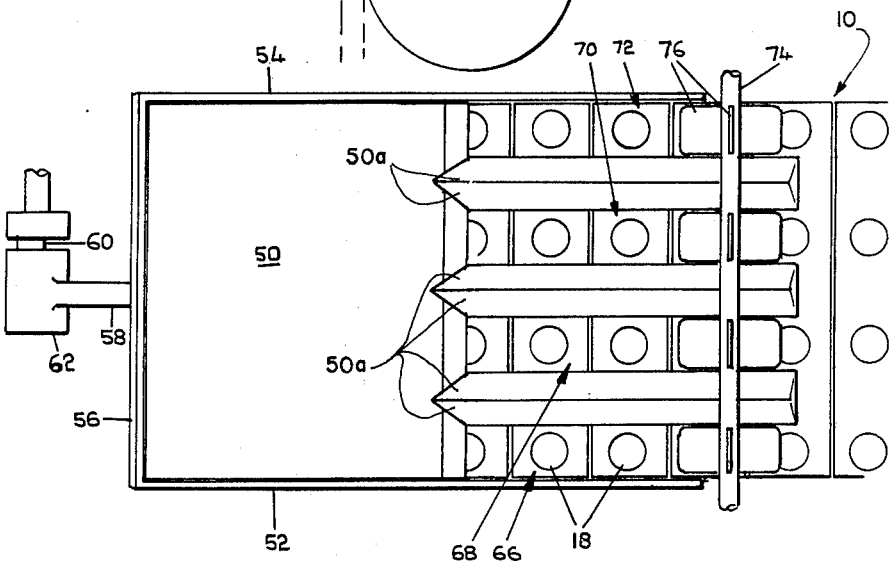
FIG. 5 is a plan view of the assembly of FIG. 4.

The feed conveyor is formed from a plurality of transverse slats (best shown in FIG. 3) each slat 16 is formed with a plurality of apertures 18 at regular intervals along its length each of the apertures being just larger than the largest diameter meat ball likely to be encountered. The apertures are aligned in longitudinal rows as best seen in FIG. 5.

The meat balls are prevented from falling through the apertures 18 by means of a tray 20 located below the conveyor between the delivery point at the lower end of the feed hopper 12 and a discharge point denoted by hoppers 22. The hoppers comprise cylindrical containers located transversely below the belt 10 in line with the positions of the apertures 18 across the slats with one hopper for each aperture. The lower end of each of the hoppers 22 is open and meat balls falling therein will normally pass straight through the hopper but can be prevented from doing so by means of a flap 24 which is operated by an arm 26 from a mechanism which is driven synchronously with the drive to the belt 10.

Immediately below the line of hoppers is a can conveyor generally designated 28 on which cans to be filled are located at one end generally designated 30 (see FIG. 2) and from which filled cans can be removed from the end generally designated 32.

Stops 34 and 36 are provided along the length of the can conveyor so as to cause an appropriate number of cans to be located as a single batch between the two stops upon operation of the can conveyor. This is achieved by first of all opening stop 36 and allowing a batch of filled cans to be removed by the can conveyor towards the end 32. As soon as the last filled can has gone beyond the stop 36, this stop is closed once again and the stop 34 is opened so as to allow the conveyor to bring empty cans into the filling station below the conveyor. As soon as the last filled can has gone beyond the stop 36, this stop is closed once again and the stop 34 is opened so as to allow the conveyor to bring empty cans into the filling station below the conveyor. As soon as the appropriate number of cans have been located by the conveyor at the filling station so that the leading empty can is abutting the end stop 36, the stop 34 is closed thereby containing the batch of empty cans below the hoppers 22.

A single can 38 is shown in the view of FIG. 1 and the mode of operation is as follows:

1. With the empty cans located in position, the flap 24 is moved aside thereby allowing the contents of the hoppers 22 to be dumped into the empty cans. The speed of operation of the belt 10 and synchronous operation of the lever 26 is such that approximately 50% of the contents of the cans will be waiting in the hoppers at the moment when the flap 24 is moved aside.

2. Continued operation of the feed conveyor 10 conveys more meat balls to the discharge point and as they arrive so these drop through the apertures 18 beyond the edge of the tray 20 and fall straight through the hoppers 22 while the flap 24 is maintained to one side and continue to fill the empty cans 38 below.

3. After a prescribed interval of time synchronised with the speed of operation of the belt a given number of meat balls will have been delivered to each of the cans and the flap 24 is then closed under appropriate action of the lever 26.

4. The end stop 36 is then opened and the filled cans moved as a single batch by the can conveyor out of the filling station. While this is happening the feed conveyor 10 continues to deliver meat balls to the discharge point and the first half of the meat balls which are to be deposited in the next line of empty cans begins to be accumulated in the hoppers 22.

5. The end stop 34 is opened and the end stop 36 closed and the next batch of empty cans are located below the hoppers 22 by the can conveyor 28 and the cycle is repeated as the flap 24 is once again moved aside.

Mounted over the top of the discharge point is a roller 40 which is adapted to push any meat ball which happens to be stuck in the aperture 18 through the aperture to ensure that all meat balls in the conveyor are dumped into their appropriate hoppers.

The lever 26 and end stops 34 and 36 are conveniently operated by means of air cylinders which may be actuated by cam operated valve means or the like driven by the main drive system for the conveyor.

In accordance with the preferred feature of the invention a vibratory hopper is provided for filling the apertures of the feed conveyor. The hopper comprises a tray 50 having side cheeks 52, 54 and a rear wall 56. Articles which are to be supplied to the feed conveyor are poured onto the tray. The vibration is obtained by a link 58 joining the underside of the tray 50 to an eccentrically mounted pin 60 and a boss 62 which is rotated to control the speed.

At the forward end of the tray 50 the tray is cut away and formed into sloping walls **50*a* to leave four parallel lanes 66, 68, 70 and 72 and the floor of the tray is replaced in the cutout regions by the feed conveyor belt 10. The latter includes the apertures 18 into which the articles can just fit so as to be wholly (or nearly so) accommodated within the depth thereof. The sloping walls 50*a*, together with the side cheeks 52, 54, confine the articles being fed in a manner to conform to the longitudinal rows of the apertures 18**.

Figure 4A:
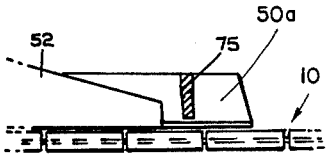
FIG. 4A is a side view of part of a modified vibratory hopper as shown in FIG. 4.
Figure 4:
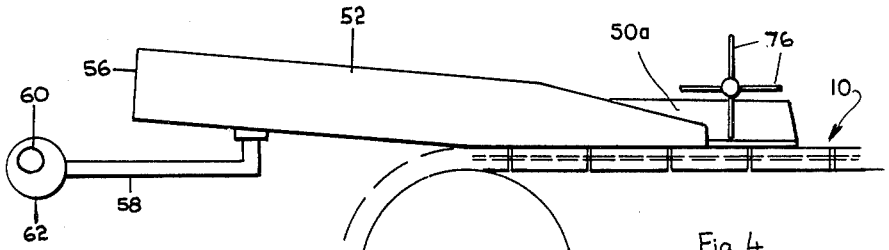
FIG. 4 is a side view of a vibratory hopper and rotary finger assembly.

Transversely across the lanes 66 to 72 extends a driven axle 74 on which are mounted four arrays of radially extending fingers 76. The axle 74 (and therefore the four arrays of fingers 76) is rotated in a clockwise direction (with reference to FIG. 4) so that any articles left on the surface of the conveyor and not in one of the apertures or recesses 64 is swept up and back onto the hopper 52 under the action of the fingers 76. Alternatively the axle 74 and radial fingers 76 may be replaced by a fixed stop bar 75 which extends transversely across the vibratory feeder 50, as shown in FIG. 4A.

I claim:

1. An apparatus for simultaneously filling each of a plurality of containers with a plurality of articles, said apparatus comprising in combination:

feed conveyor means for conveying and retaining said articles, said conveyor means comprising endless belt means having an upper run and a lower run spaced below the upper run and with its upper run moving in a given direction, said conveyor means defining a given number of longitudinal rows of apertures transversely aligned with each other, said apertures being open at the top and bottom, and a tray along a portion of said upper run and immediately below said belt means and extending in said direction from a first point to a second point to thereby close the bottom of said apertures along said portion of said upper run only;

filling means above said portion and adjacent said first point for filling each aperture with a single article only;

a plurality of hoppers positioned in the space between said runs and in said direction from said second point and immediately adjacent thereto, each hopper having an open top and an open bottom and being below a respective longitudinal row, whereby when an article in an aperture passes said second point it falls from the aperture into the respective hopper;

another conveyor means for moving empty containers in batches beneath the hoppers and for removing filled containers after filling, each batch corresponding in number to said given number, said other conveyor means being in said space, transversely aligned to said runs, and positioned below the hoppers, and including means for arresting the batch for filling with the batch being arrested with each container of the batch being below a respective hopper and held so arrested until the container is filled; and gate means positioned below the open bottoms of the hoppers and being movable between a position at which the bottoms of the hoppers are closed and a position at which the bottoms of the hoppers are open, said gate means being in the latter mentioned position when an empty batch of containers is located beneath the hoppers to thereby permit the contents of the hoppers to descend into the containers and being moved to the first mentioned position thereof when the containers are full, to thereby allow a batch of filled containers to be replaced by a batch of empty containers ready to be filled.

2. An apparatus as set forth in claim 1, wherein said belt means comprises a plurality of transverse slats, each slat extending the width of the feed conveyor means and having a top, a bottom and openings therethrough from top to bottom with the slat forming walls about and defining each opening, each opening being in a respective longitudinal row and forming one of said apertures, as seen when the slat is in the upper run each opening being larger in horizontal cross section at the bottom thereof than at the top with the walls about the opening sloping outwardly from top to bottom whereby an article entering the top of the opening will discharge through the bottom with relative ease.

3. An apparatus as set forth in claim 1, wherein said filling means includes a rotary member having a plurality of rows of radial projections with each such row being aligned with a respective longitudinal row, the projections of each row of projections being in planes common to the projections of the remaining rows of projections, said projections extending sufficiently close to said feed conveyor means to displace any articles not already in apertures while not displacing articles already received in the apertures, said rotary member being rotated in a direction such that when the projections are most closely adjacent said feed conveyor means said fingers are moving generally opposite to said given direction, and means adjacent said first point and above the feed conveyor for confining, to each of said longitudinal rows, the articles being fed to the feed conveyor means.

4. Apparatus as set forth in claim 1 in which the feed conveyor means is synchronized with the operation of the gate means such that some of the articles to be deposited in the empty containers are collected in the hoppers while the gate means are shut and the remainder of the articles to be deposited in the containers drop from the feed conveyor means into the hoppers as the latter passes over the hoppers while the gate means remains open.

* * * * *